US005562204A

United States Patent [19]

Sapyta et al.

[11] Patent Number: 5,562,204

[45] Date of Patent: Oct. 8, 1996

[54] FOLDABLE CARRYING CASE

[75] Inventors: Rachel T. Sapyta, 15415 Triple Creek, San Antonio, Tex. 78247; Gerald R. Wilson, San Antonio, Tex.

[73] Assignee: Rachel Theora Sapyta, San Antonio, Tex.

[21] Appl. No.: 288,994

[22] Filed: Aug. 11, 1994

[51] Int. Cl.[6] ..... A45C 13/10; A45C 9/00

[52] U.S. Cl. ..... 206/748; 190/18 A; 190/110; 190/119; 224/257

[58] Field of Search ..... 190/16, 17, 18 A, 190/109–111, 119; 206/45.11, 45.13, 45.15, 45.18, 6.1, 472; 229/87.01, 87.06; 211/113, 117, 118; 220/338; 224/257

[56] References Cited

U.S. PATENT DOCUMENTS

| | | | |
|---|---|---|---|
| 1,061,374 | 5/1913 | Harrington | 206/45.11 |
| 1,085,950 | 2/1914 | Steinthal | 190/16 |
| 1,866,323 | 7/1932 | Russell | 206/45.11 |
| 2,112,062 | 3/1938 | Berger | 206/45.11 |
| 2,463,391 | 3/1949 | Kanaley | 190/18 A |
| 3,650,381 | 3/1972 | Weindling | 206/45.11 |
| 4,287,986 | 9/1981 | Beck | 206/472 |
| 4,386,642 | 6/1983 | Durbin | 190/110 |
| 4,436,189 | 3/1984 | Baum | 190/119 |
| 4,852,293 | 8/1989 | Levine et al. | 190/110 |
| 4,951,812 | 8/1990 | Chen | 206/45.11 |
| 4,967,913 | 11/1990 | Bayer | 211/118 |
| 5,002,401 | 3/1991 | Blackman | 190/109 |
| 5,125,519 | 6/1992 | Cambria | 211/118 |
| 5,125,523 | 6/1992 | Kulper | 220/338 |
| 5,291,990 | 3/1994 | Sejzer | 206/45.11 |

FOREIGN PATENT DOCUMENTS

| | | | |
|---|---|---|---|
| 2419692 | 11/1979 | France | 190/16 |
| 184586 | 5/1907 | Germany | 190/16 |
| 162197 | 4/1921 | United Kingdom | 206/45.11 |
| 490148 | 8/1938 | United Kingdom | 206/45.11 |

*Primary Examiner*—Jimmy G. Foster
*Attorney, Agent, or Firm*—Gunn, Lee & Miller, P.C.

[57] ABSTRACT

A carrying case that is comprised of a member made up of a multiplicity of rectangular sections. The sections are connected along adjacent edges by hinges, allowing the member to be folded from a flat position to a folded position, the folded position defining the rectangular or quadrilateral shaped carrying case. The inner surfaces of some of the sections of the member have individual pocket-shaped storage compartments.

17 Claims, 6 Drawing Sheets

FOLDABLE CARRYING CASE

FIELD OF THE INVENTION

A foldable carrying case, specifically, a foldable carrying case comprised of a flat laying member having a multiplicity of sections, the member being capable of being folded into a rectangular or quadrilateral carrying case.

BACKGROUND OF THE INVENTION

Carrying cases come in all sizes and shapes, but each provides a means of easily transporting articles or goods within the case. Some carrying cases also provide compartments on the interior surfaces thereof to help organize the individual articles being transported.

A need exists for a rectangular or quadrilateral shaped carrying case which is made up of a multiplicity of sections that can be unfolded, and that can convert the rectangular or quadrilateral shaped carrying case into a flat laying member with individual compartments, capable of containing a number of articles, found on the inner surfaces of the wall forming sections of the carrying case.

What has been heretofore unavailable is a carrying case that can serve as a means of organizing and displaying individual articles contained within the case, and that can also unfold in such a manner that the inner surface of the walls of the case are a means to both organize and display the contents held within the individual compartments. That is, applicants have provided a rectangular or quadrilateral shaped carrying case made up of a number of foldable sections, the inner surfaces of which carry pockets or compartments for organizing the articles contained within the case, organized in such a manner that when the case is unfolded and hung in an upright position, the individual sections have easily accessible compartments designed to efficiently hold and display articles.

Applicants' invention further provides that the foldable member, formed by a multiplicity of foldable sections, can be detached into two or more panels, each panel being made up of a multiplicity of sections and, further, each panel is capable of being hung in a vertical plane, exposing the compartments used for organizing and displaying articles to the user.

Applicants' unique, foldable member that forms a rectangular or quadrilateral shaped carrying case is further provided with a section that partially or completely unfastens such that when the member is in the rectangular or quadrilateral shaped carrying configuration, the section can be unfastened from adjacent sections without disturbing the shape of the carrying case, thus allowing easy access to the contents of the carrying case. Thus, applicants' carrying case provides access to the interior thereof in one of two ways: by either unfolding the case from its typical rectangular or quadrilateral shape to a flat laying member or by partially or fully detaching, typically by unzipping, one of the sections forming the exterior wall of the rectangular carrying case from adjacent sections to provide access to the interior thereof.

Applicants' unique carrying case further provides a means to remove and detach individual article containing compartments from the interior walls of the sections comprising the carrying case when the carrying case is in the folded or unfolded configuration. Such removal can be effected without altering the folded, rectangular shape of the carrying case.

SUMMARY OF THE INVENTION

The invention is a carrying case for transporting and organizing articles. The carrying case is a member comprised of a multiplicity of flat, rectangular sections having edges, and joined along adjacent edges by hinges. The sections have an outer and inner surface and the inner surfaces usually have storage means such as compartments thereon. The carrying case member can be in either a flat position, or a folded position, whereas when in the folded position, the outer walls of at least some of the sections define an exterior surface of the carrying case.

The invention carrying case is a foldable member comprised of a first panel and a second panel, the first panel having at least one section and the second panel having at least another section. The total member made up of these two panels has means to separate these two panels to form two hanging panels or having a means to attach these two panels together to form one member.

This and other objects are provided for in a carrying case comprised of a foldable member made from a multiplicity of flat laying sections. Whereas at least one of the sections can be unfastened from adjacent sections by the means of zippers or the like, such unfastening providing access to the interior of the carrying case, while the member is in the folded position.

DETAILED DESCRIPTION OF THE PREFERRED EMBODIMENT

Figure 1:
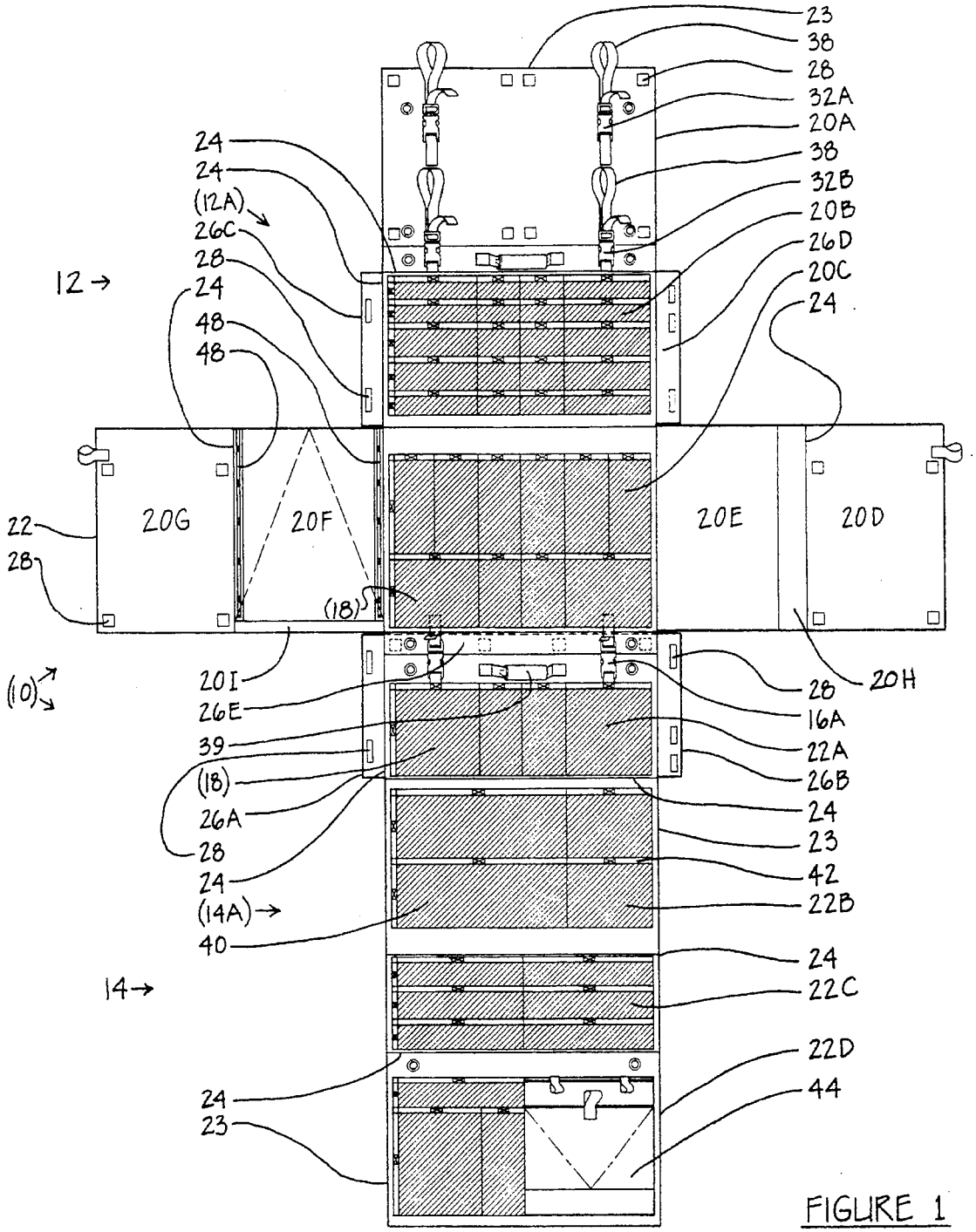
FIG. 1 is an interior elevation view of the carrying case of applicants' invention in an unfolded (flat laying) position illustrating the inner surface thereof.
Figure 2:
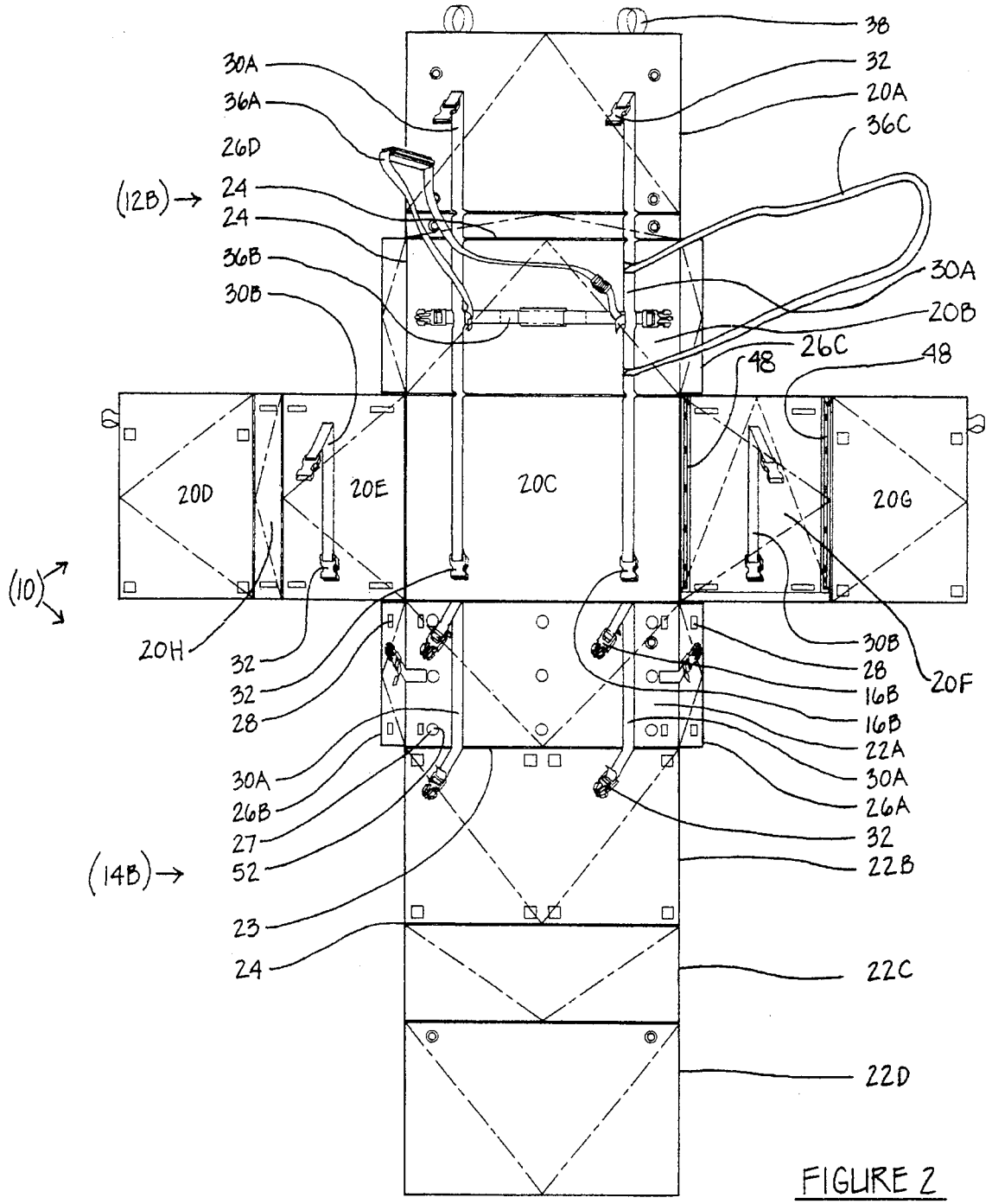
FIG. 2 is an exterior elevation view of the carrying case of applicants' invention in an unfolded (flat laying) position illustrating the outer surface thereof.
Figure 3:
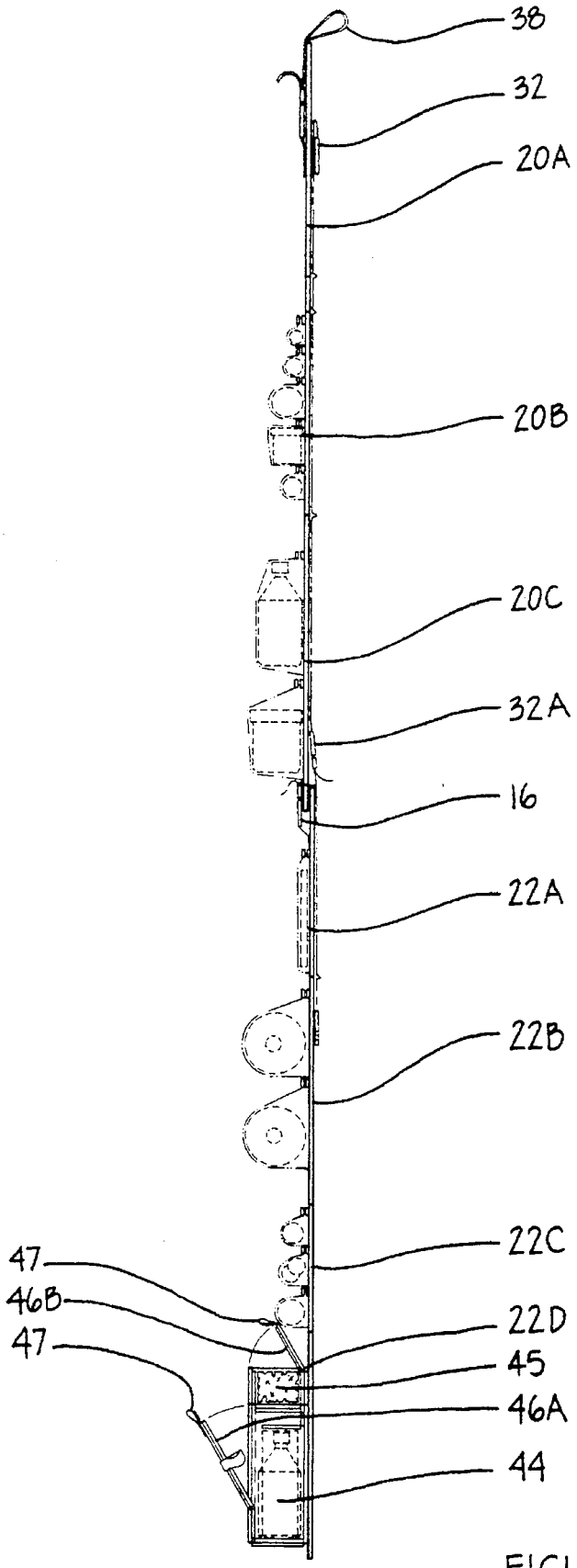
FIG. 3 is a side elevation view of the right side of applicants' carrying case (as viewed in FIG. 1) with sections (**26*b*), (26*d*), (20*e*), (20*h*) and (20*d***) removed therefrom.

FIGS. 1, 2 and 3 illustrate foldable member (10) of applicants' carrying case in a flat or unfolded position. As can be appreciated with reference to FIGS. 1–3, foldable member (10) of applicants' carrying case is typically comprised of two panels removably joined to form the foldable member with the panels having an inner and outer surface.

Specifically, FIGS. 1–3 illustrate foldable member (10) being comprised of a first panel (12), the first panel having an inner surface (**12*a*) and an outer surface (12*b*). Likewise, second panel (14) has an inner surface (14***a*) and an outer surface (14*b*). First panel (12) and second panel (14) are removably Joined by interior connector (16*a*) and exterior connector (16*b*), typically, as illustrated here, plastic buckles of a conventional sort having male and female members and/or including but not limited to a hook and loop system.

To be appreciated with reference to FIGS. 1–3 is the design of inner surfaces (12*a*) and (14*a*). More specifically, FIGS. 1 and 3 illustrate that the inner surfaces of the two panels (12) and (14) are substantially covered with a number of storage compartments (18) designed to hold and display articles of a variety of shapes and sizes in an organized fashion. The layout of storage compartments (18) illustrates that each compartment has a top and a bottom, the top for inserting the articles and a bottom for preventing the articles from falling out of the storage compartment. The storage compartments are typically pocket-shaped and, it is noted, are arranged such that foldable member (10) with panels (12) and (14) can be united or connected by placing the top of panel (14) on flap (26*e*) located at the bottom of panel (12) and attaching connectors (16*a*) and (16*b*). More details relating to storage compartment (18) are set forth below.

Turning now to the construction of the panels forming foldable member (10) of applicants' present invention it is seen that they are comprised of a multiplicity of smaller, rectangular-shaped sections (20). For ease in understanding the nature of these sections and their relationship to member (10), applicant, for clarity has designated each section as follows. First panel (12) is comprised of typically rigid, fabric-covered (alternatively plastic) sections (20*a*), (20*b*), (20*c*), (20*d*), (20*e*), (20*f*), (20*g*) and (20*h*) and flaps (26*c*), (26*d*) and (26*e*). Second panel (14) is comprised of sections (22*a*), (22*b*), (22*c*), (22*d*) and flaps (26*a*) and (26*b*) using the same materials as first panel sections. Edges (23) define the boundaries of the sections of the panels.

Turning now to first panel (12), it is seen, with reference to FIGS. 1, 2, 6 and 7, that sections (20*a*) and (20*c*) represent front and rear exterior walls of the carrying case when in the folded position (see also FIG. 7) whereas, section (20*b*) forms the exterior top surface of the carrying case. Moreover, with reference to FIGS. 1, 6 and 7, it is seen that when foldable member (10) is folded from its flat position to its rectangular or box position, section (20*a*) having no storage compartments on inner surface (12*a*) thereof, folds flat against section (22*b*). Both sections (20*b*) and (20*c*) have storage compartments (18) on the inner surface (12*a*) thereof. Furthermore, sections (20*g*), (20*d*) and (20*h*) [having no storage compartments on their interior surface (12*a*)] fold flat against the exterior surface (12*b*) of section (22*b*).

Continuing now to examine the structure and function of the various sections comprising folding member (10), attention is directed to section (22*a*) which lies adjacent section (20*c*) with its outer surface (14*b*) having feet (27) or (alternately) wheels (52) mounted thereon for support of the carrying case on a surface such as the floor or the ground. Further, it is seen that section (22*a*) has storage compartments (18) on inner surface (14*a*) thereof.

Figure 7:
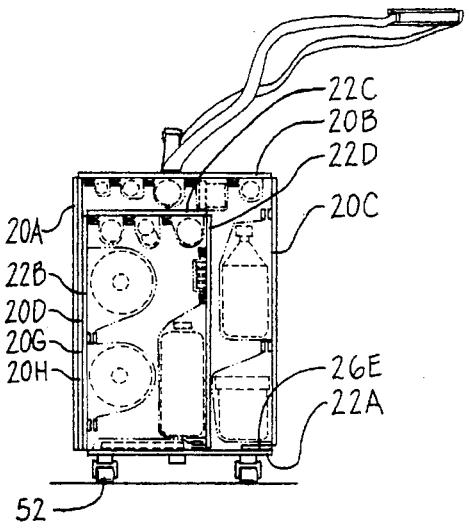
FIG. 7 is a left side elevation view of applicants' carrying case in a folded position with sections (**20*e*) and (20*h***) removed therefrom, showing the configuration of the panels and sections comprising the carrying case.

When member (10) is in the folded position, section (22*b*) is approximately perpendicular to section (22*a*). Furthermore, outer surface (14*b*) of section (22*b*) lays flush against inner surfaces (12*a*) of sections (20*g*), (20*d*) and sometimes (20*h*). Section (20*h*) changes external shape from approximately quadrilateral to approximately rectangular when the edges of sections (20*g*) and (20*h*) abut. With further reference to FIG. 7, it is seen that the outer surfaces of sections (20*g*) and (20*d*) lay flush against inner surface (12*a*) of section (20*a*) with the hook and loop fasteners engaged as set forth in more detail below. Of course, it is to be appreciated that the dimensions of the various sections are such that they fit together to form the "box in box" structure that is most evident in FIG. 7. Also note that the exterior surface (14*b*) of section (22*b*) has fasteners such as, but not limited to, hook and loop which corresponds to receptive fastener portions mounted in interior (12*a*) portions of sections (20*g*), (20*h*) and (20*d*) to attach these panels to interior surface (12*a*) of (20*a*) when folded. Furthermore, both interior surfaces (12*a*) and exterior surfaces (12*b*) of panels (20*g*), (20*h*) and (20*d*) have fasteners such as, but not limited to hook and loop so that when (20*g*) and (20*d*) overlap during folding, they are secured to each other as well as to exterior surface (14*b*) of panel (22*b*). Further, with reference to FIG. 7, it is seen that sections (22*b*) and (22*d*) do not stand as high as sections (20*c*), (20*g*), (20*h*), (20*d*) and (20*a*). This is to obtain the box in a box structure.

Figure 5A:
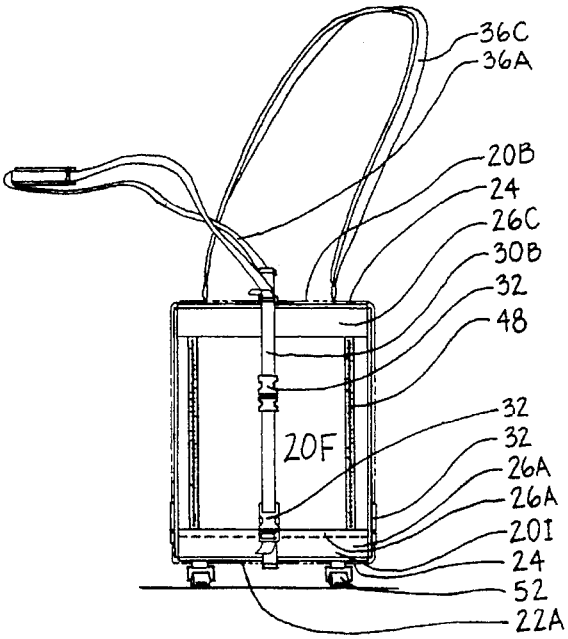
FIGS. 5A and 5B represent elevation views of the left side and right side of applicants' present invention in the folded carrying case configuration.
Figure 5B:
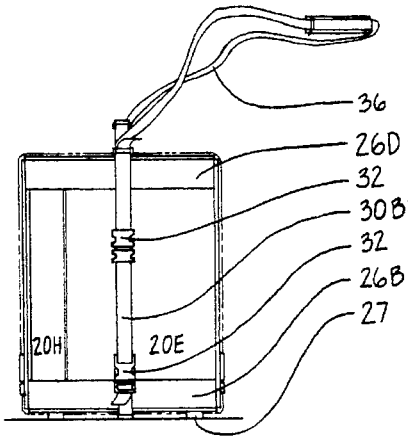

FIGS. 5A and 5B illustrate additional details of the use of applicants' invention. It is seen from FIGS. 5A and 5B how flaps (26*a*), (26*b*), (26*c*) and (26*d*) and the related hook and loop fasteners (28) located on various parts of folding member (10) engage various sections to give a box-like, rectangular or quadrilateral structure to the folded member 10. Further, flaps (26*a*), (26*b*), (26*c*) and (26*d*) also serve to totally enclose the interior compartment of folded member (10). More specifically, FIGS. 5A and 5B illustrate the manner in which flaps (26*a*) and (26*c*) fold along hinges (24) such that they are approximately perpendicular to sections (20*f*) and further, how flaps (26*d*) and (26*b*) fold along hinges (24) such that they are approximately perpendicular to sections (20*e*) or (20*e*) and (20*h*). FIGS. 5A and 5B also illustrate the manner in which fasteners (28) on flaps (26*a*) and (26*c*) engage fasteners on the outer surface of section (20*i*) and (20*f*) as well as the manner in which fasteners (28) on flaps (26*b*) and (26*d*) engage fasteners on the outer surface of section (20*e*) or sections (20*e*) and (20*h*). Further, it is seen in FIG. 5A that section (20*f*) has zippers (48) on either side thereof, to allow access to the inside of the carrying case. Note that in an alternative preferred embodiment, the carrying case and folding member could function adequately without the flaps.

Last, it is seen how straps (30*b*) wrap around the exterior of the carrying case and are connected at connectors (32) and may be cinched down with adjustment at the connectors. FIG. 5B, on the other hand, illustrates the manner in which the outer surface of section (20*e*), or (20*e*) and (20*h*) are positionally maintained through the use of flaps (26*b*) and (26*d*) combined with fasteners (28) to engage the inner surfaces of the flaps with the outer surface of section (20*e*) or (20*e*) and (20*h*). Again, straps (30*b*) and connectors (32) help complete the securing of member (10) into its folded configuration.

Turning back now to FIGS. 1, 2, 3, 4A, 4B and 5B, it is seen that there are additional details to applicants' invention. More specifically, it is seen that the carrying case configuration is maintained by the use of straps (30*a*) and (30*b*) connected by buckles (32) or comparable connectors. Completing the exterior of the carrying case configuration are carrying straps (36*a*), (36*b*) and (36*c*). Carrying strap (36*a*) is for carrying from a shoulder. Carrying strap (36*c*) is for dragging across the floor on wheels (52). Carrying strap (36*b*) is for lifting by hand.

Member (10) is capable of laying flat or being hung vertically so that storage compartments (18) are exposed for use. The hanging of member (10) is facilitated through the use of removable adjustable hanging loops (38) which hook into buckles (32*a*), (32*b*) or (16*a*) depending on the hanging configuration desired. Varying hanging configurations can be achieved by connecting the removal, adjustable hang loops to buckles (32*a*), (32*b*) and/or (16*a*). Member (10) can be either hung in one piece by connecting section (12) to section (14) and hanging member (10) from loops (38) connected to buckles (32*a*) or (32*b*), or member (10) may be divided into two sections (12) and (14) and may be hung by loops (38) connected to buckles (32*a*) or (32*b*) as well as buckle (16*a*).

Figure 4A:
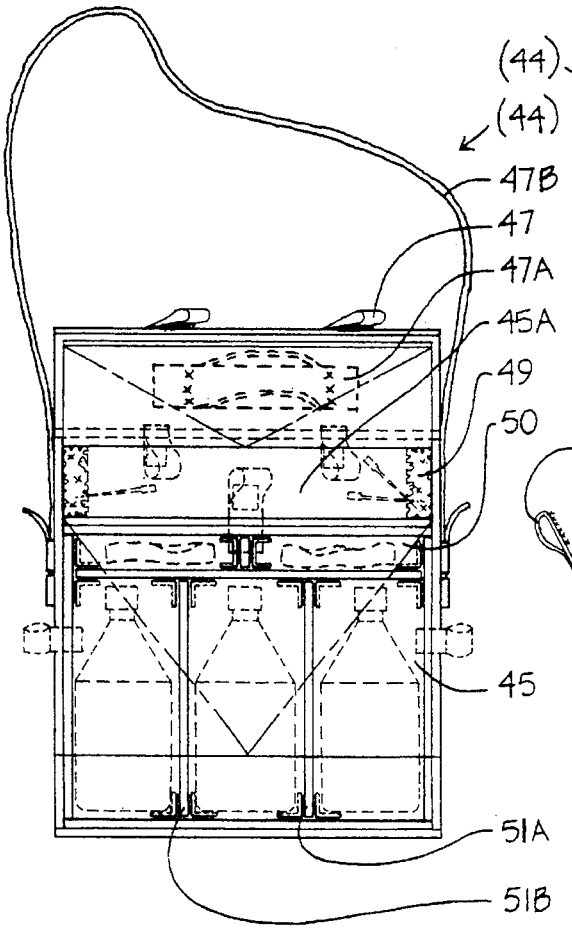
FIGS. 4A and 4B are front and side elevation views of the insulated cooler storage compartment portion of applicants' present invention as removed from the foldable member comprising the carrying case as set forth in FIGS. 1, 2 and 3 above.
Figure 4B:
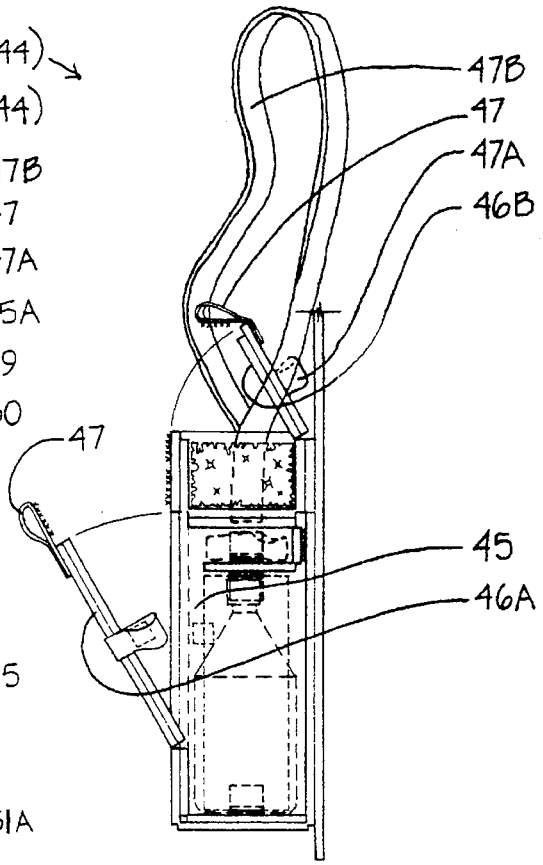

Turning now to more detail of inner surfaces (12*a*) and (14*a*), it is seen that most of these surfaces are provided with a multiplicity of pocket-shaped storage compartments (18). More specifically, storage compartments (18) are preferably made of any product or material (40) that allows the user to view the goods while they are contained within the compartment. Moreover, storage compartments (18) may have, but are not limited to having, a flap or lip that connects to the interior surface of the member (42). While the storage compartments are in a variety of sizes and shapes, applicants do provide, further, for the unique ability of at least one of the storage compartments to be removed from the section to which it is attached and therefore separated from member (10). In FIGS. 1, 4A and 4B, applicants illustrate a unique removable storage compartment (44), specifically a storage compartment comprising a cooler (45) which may or may not be insulated and a needle compartment (45*a*). Opening flaps (46*a*) and (46*b*) provide access to the cooler (45) and the needle compartment (45*a*), respectively. Flaps or handles (47), having hook and pile fasteners, provide for secure closure to the compartments. Handle (47*a*) and/or removable shoulder strap (optional) (47*b*) allows removable storage compartment (44) to be easily carried or hung on support. Foam cork (or comparable material) (49) in needle compartment (45*a*) allows for the insertion and retention of used hypodermic needles therein. Dividers (51*a*) and (51*b*) are removable so that the interior compartments of removable storage compartment can adjust in size.

Figure 6:
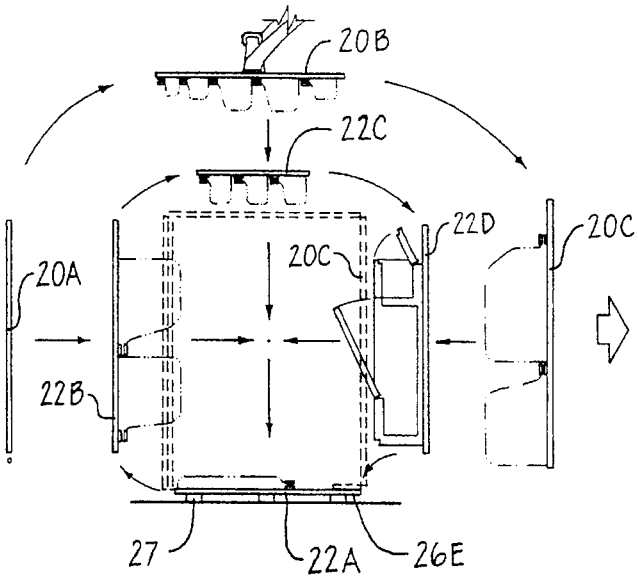
FIG. 6 is an exploded right side elevation view showing how the sections of applicants' folding member fold into the rectangular carrying case configuration.

To fold member (10) into the rectangular or quadrilateral shape, the following steps are taken: section (22*d*) is lifted approximately parallel to section (22*b*). This forces section (22*c*) to be approximately perpendicular between sections (22*d*) and (22*b*). Viewing folding as illustrated in FIG. 6, combination fold of sections (22*d*), (22*c*), (22*b*) is then folded clockwise (as viewed from right) so that section (22*c*) is approximately parallel to section (22*a*). This forms a quadrilateral box comprised of sections (22*d*), 22(*c*), (22*b*) and (22*a*). This quadrilateral box is then flipped clockwise so that exterior surface (14*b*) of section (22*d*) lays against pocket (18) attached to the interior surface (12*a*) of section (20*c*). Sections (20*g*) and (20*d*) are then brought forward so that their respective interior surfaces (12*a*) fold flush against exterior surface (14*b*) of section (22*b*). Interior surface (12*a*) of section (20*a*) is then folded flush to meet exterior surfaces (12*b*) of sections (20*d*), (20*g*) and optionally (20*h*). Folded member (10) is then positioned so that section (22*a*) is on the bottom. Flaps (26*b*) and (26*d*) are folded to secure section (20*e*) or sections (20*e*) and (20*h*). Flaps (26*c*) and (26*a*) are folded to engage sections (20*f*) and (20*i*). All buckles are connected and cinched to tighten. All buckles should be fastened and all complimentary hook and loop fasteners (28) should be appropriately engaged. The carrying case is then ready to be transported by means of carrying or rolling on its wheels.

It should be appreciated that applicants' present invention may be used in relation to carrying any type of articles or goods. Thus, the individual compartments on the interior surfaces of the sections may be designed in a variety of shapes. Moreover, the dimensions of the sections may be altered to make the carrying case smaller or larger, wider, longer, etc. Applicants' specifications are intended to point out only a specific embodiment of sections and compartments, but anticipates more generally a foldable carrying case.

Alternative preferred embodiments of applicants' present invention include means, such as hook and loop fasteners, for removing sections 20(*f*) and 20(*e*) from section 20(*c*). Further, providing pockets on the inner surfaces of sections 20(*e*) and 20(*f*) will allow them to carry articles and, if they are removed from section 20(*c*), to be hung adjacent the other sections and/or panels. Further, hanging loops 38 may be made of metal, such as a metal rod shaped in an inverted "j" shape, to hang from a bar. In addition, alternative preferred embodiments are provided allowing section 20(*f*) to be unfastened completely from adjacent sections 20(*g*) and 20(*c*) for further access to the interior of the carrying case when in its folded configuration.

Last, zippers 48 may, in a preferred alternate embodiment, be any type of fastener capable of performing the same function as zippers. The case may be supported on feet, wheels, or a combination of feet and wheels.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A carrying case for transporting and organizing articles therein, the carrying case comprising:

a member comprised of a multiplicity of flat rectangular sections having edges, the sections joined along adjacent edges by a multiplicity of hinges, each of the sections having an outer and an inner surface, the inner surface of some of the sections having storage means thereon, said member being foldable between a flat position and a folded position, the folded position wherein the outer walls of at least some of the sections define an exterior surface of the carrying case; wherein said member is comprised of a first panel and a second panel, the first panel comprised of at least three of the multiplicity of sections and the second panel comprised of at least two of the multiplicity of sections of said member; wherein at least three of the sections of the first panel are aligned along an axis generally perpendicular to an axis of alignment of the at least two sections of the second panel, the carrying case further comprising means to removably fasten the first panel to the second panel and means to suspend at least one of the panels vertically from a support means.

2. The device of claim 1, wherein at least one of the storage means of the sections is removable from the inner surface of the section.

3. The device of claim 1, wherein at least one of said sections is joined to adjacent sections by fasteners such that access to the interior of the case is provided by unfastening the fasteners.

4. The device of claim 1 further comprising means to aid in maintaining said member in the folded position of the carrying case.

5. The device of claim 1 wherein the outer surface of one of the sections of either of the first panel or the second panel has wheels mounted thereto for rollingly supporting said member when in the folded position.

6. The device of claim 1, wherein at least one of the storage means is removable from the inner surface of the section and wherein at least one of said sections is joined to adjacent sections by fasteners such that access to the interior of the case is provided by unfastening.

7. The device of claim 1, wherein at least one of the storage means of the sections is removable from the section and further comprising means to aid in maintaining the folded position of the member carrying case.

8. The device of claim 1, wherein at least one of said sections is joined to adjacent sections by fasteners such that access to the interior of the case is provided by unfastening and further providing hook and loop fasteners adapted to aid in maintaining the folded position of the carrying case.

9. The device of claim 1, wherein at least one of the storage means of the sections is removable from the inner surface and wherein the outer surface of one of the sections of either of the first panel or the second panel has wheels mounted thereto for rollingly supporting the carrying case when in the folded position.

10. The device of claim 1, wherein at least one of said sections is joined to adjacent sections by fasteners such that access to the interior of the carrying case is provided by unfastening and wherein the outer surface of one of the sections of either of the first panel or the second panel has wheels mounted thereto for rollingly supporting the carrying case when in the folded position.

11. The device of claim 1 further comprising hook and loop fasteners adapted to removably locate sections adjacent to one another in the folded position, so as to aid in maintaining the folded position of the carrying case, wherein the outer surface of one of the sections of either of the first panel or the second panel has wheels mounted thereto for rollingly supporting the carrying case when in the folded position.

12. The device of claim 1, wherein at least one of the storage means of the sections is removable from the inner surface, wherein at least one of said sections is joined to adjacent sections by zippers such that access to the interior of the case is provided by unzipping, and further comprising hook and loop type fasteners adapted to aid in maintaining the folded position of the carrying case, wherein the outer surface of one of the sections of either of the first panel or the second panel has wheels mounted thereto for rollingly supporting the carrying case when in the folded position.

13. A carrying case for transporting and organizing articles therein, the carrying case comprising:

a member comprised of a multiplicity of flat rectangular sections having edges, the sections Joined along adjacent edges by a multiplicity of hinges, each of the sections having an outer and an inner surface, the inner surface of some of the sections having storage means thereon, wherein the storage means of the inner surface of said members are pockets comprised of a material covering capable of revealing the identity of the articles contained therein, said member being foldable between a flat position and a folded position, the folded position wherein the outer walls of at least some of the sections define an exterior surface of the carrying case;

wherein said member is further comprised of a first panel and a second panel, the first panel comprised of at least three of the multiplicity of sections and the second panel comprised of at least two of the multiplicity of sections of said member, wherein at least three of the sections of the first panel are aligned along an axis generally perpendicular to axis of alignment of the at least two sections of the second panel, the carrying case, further comprising means to removably fasten the first panel to the second panel and means to suspend at least one of the panels vertically from a support means.

14. The device of claim 13, wherein at least one of the storage means of the sections is removable from the inner surface of the section.

15. The device of claim 14, wherein at least one of said sections is joined to adjacent sections by zippers such that access to the interior of the case is provided by unzipping.

16. The device of claim 15, further comprising hook and loop type fasteners adapted to aid in maintaining said member in the folded position of the carrying case.

17. The device of claim 16, wherein the outer surface of one of the sections of either of the first panel or the second panel has wheels mounted thereto for rollingly supporting said member when in the folded position.

* * * * *